US009711106B1

(12) United States Patent
Wang et al.

(10) Patent No.: US 9,711,106 B1
(45) Date of Patent: Jul. 18, 2017

(54) DISPLAY METHOD AND DISPLAY DEVICE

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Di Wang, Beijing (CN); Hao Zhang, Beijing (CN); Lingyun Shi, Beijing (CN); Jialong Li, Beijing (CN); Shuai Han, Beijing (CN); Xue Dong, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 15/105,889

(22) PCT Filed: Jan. 6, 2016

(86) PCT No.: PCT/CN2016/070226

§ 371 (c)(1),
(2) Date: Jun. 17, 2016

(87) PCT Pub. No.: WO2017/008475

PCT Pub. Date: Jan. 19, 2017

(30) Foreign Application Priority Data

Jul. 15, 2015 (CN) ..... 2015 1 0416449

(51) Int. Cl.
*G09G 3/36* (2006.01)

(52) U.S. Cl.
CPC ..... *G09G 3/3696* (2013.01); *G09G 3/3677* (2013.01); *G09G 2320/0613* (2013.01); *G09G 2330/021* (2013.01)

(58) Field of Classification Search
None
See application file for complete search history.

(56) References Cited

U.S. PATENT DOCUMENTS 7,019,716 B2 * 3/2006 Tsai ..... G09G 3/2022 345/60
8,912,994 B2 * 12/2014 Liu ..... G09G 3/3611 345/99

(Continued)

FOREIGN PATENT DOCUMENTS

CN 101174064 A 5/2008
CN 102542990 A 7/2012

(Continued)

OTHER PUBLICATIONS

International Search Report dated Mar. 25, 2016 corresponding to International application No. PCT/CN2016/070226.

*Primary Examiner* — Patrick F Marinelli
(74) *Attorney, Agent, or Firm* — Nath, Goldberg & Meyer; Joshua B. Goldberg

(57) ABSTRACT

The present invention provides a display method and a display system, which belong to the field of display technology and solve a problem of large power consumption in the case of light-load images in existing display methods. The display method includes steps of: detecting, when a frame of image is displayed, a variation degree of data voltages on respective data lines; determining, according to the detection result, a load size of the displayed image; and adjusting, according to the determination result, an operating frequency of a charge pump, and outputting, by the charge pump, a voltage corresponding to the operating frequency to a gate driving unit, so that a gate driving voltage is provided to a gate line by the gate driving unit. The overall power consumption of a display system can be reduced and the (Continued)

performance thereof can be improved by the display method according to the present invention.

18 Claims, 4 Drawing Sheets

(56) References Cited

U.S. PATENT DOCUMENTS 8,917,228 B2 * 12/2014 Liu ..... G09G 3/3611 345/92
9,202,441 B2 * 12/2015 Liu ..... G09G 3/3611
9,274,358 B2 * 3/2016 Liu ..... G09G 3/3611
9,343,952 B2 * 5/2016 Xi ..... H02M 3/07
9,396,689 B2 * 7/2016 Liu ..... G09G 3/3648
2003/0206186 A1 11/2003 Tsai et al.
2006/0119562 A1 * 6/2006 Ichikura ..... G09G 3/3696 345/98
2007/0279350 A1 * 12/2007 Huang ..... G09G 3/3651 345/87
2011/0080433 A1 4/2011 Park
2012/0169954 A1 * 7/2012 Liu ..... G09G 5/18 349/38
2012/0229443 A1 * 9/2012 Liu ..... G09G 5/18 345/212
2012/0320009 A1 * 12/2012 Liu ..... G09G 3/3614 345/204
2015/0049008 A1 * 2/2015 Wu ..... G09G 3/3648 345/87
2015/0070345 A1 * 3/2015 Liu ..... G09G 5/18 345/213
2015/0070618 A1 * 3/2015 Liu ..... G09G 5/18 349/43
2015/0130862 A1 * 5/2015 Miyazawa ..... G06F 3/147 345/691
2015/0333620 A1 * 11/2015 Xi ..... H02M 3/07 345/215
2015/0333737 A1 * 11/2015 Wang ..... G09G 3/3696 345/92
2015/0372589 A1 * 12/2015 Zhang ..... G09G 3/20 345/211
2016/0063962 A1 * 3/2016 Park ..... G09G 3/3611 345/211
2016/0247458 A1 * 8/2016 Muto ..... G09G 3/344
2016/0253951 A1 * 9/2016 Devegowda ..... G09G 3/32
2017/0110081 A1 * 4/2017 Han ..... G09G 3/3696

FOREIGN PATENT DOCUMENTS

CN 102737597 A 10/2012
CN 104952411 A 9/2015

* cited by examiner

DISPLAY METHOD AND DISPLAY DEVICE

This is a National Phase Application filed under 35 U.S.C. 371 as a national stage of PCT/CN2016/070226, filed Jan. 6, 2016, an application claiming the benefit of Chinese Application No. 201510416449.0, filed Jul. 15, 2015, the content of each of which is hereby incorporated by reference in its entirety.

FIELD OF THE INVENTION

The present invention belongs to the field of display technology, and specifically relates to a display method and a display device.

BACKGROUND OF THE INVENTION

A fundamental principle of displaying a frame of image by a Thin Film Transistor-Liquid Crystal Display (TFT-LCD) is that, a square wave with a certain pulse width is applied to each row of pixels sequentially from top to bottom by a gate driving circuit, so that corresponding pixels are selected and turned on, and then a desired signal is applied to each pixel of the selected row of pixels by a source driving circuit. A gate driving voltage for selecting and turning on each row of pixels is generated by the gate driving circuit, and the voltage of the voltage source of the gate driving circuit is generated by a charge pump circuit, which is used to boost a relatively low input voltage to a relatively high output voltage.

It is known to those skilled in the art that the voltage outputted by the charge pump circuit is positively related to operating frequency of the charge pump circuit. In the prior art, in order to meet requirements for outputting all kinds of images (including heavy-load images and light-load images), the operating frequency of the charge pump circuit in an initial state is generally set to meet the requirement for outputting an image with the heaviest load, which means the operating frequency is rather high. In doing so, although the requirement for outputting an image with the heaviest load is satisfied, it brings about a waste of resources in a case where light-load images make up the majority of all images. Actually, respective rows of pixels can also be driven by the charge pump circuit with a relatively low operating frequency, whereas no specific technical solution exists in the prior art to this end.

SUMMARY OF THE INVENTION

In view of the above problems in the existing display methods, the present invention provides a display method and a display device with excellent display effect and low power consumption.

The technical solution used for solving the technical problems of the present invention is to provide a display method, which comprises steps of:

detecting, when each frame of image is displayed, a variation degree of data voltages on respective data lines:

determining, according to the detection result, a load size of the displayed image; and adjusting, according to the determination result, an operating frequency of a charge pump, and outputting, by the charge pump, a voltage corresponding to the operating frequency to a gate driving unit, so that a gate driving voltage is provided to a gate line by the gate driving unit.

Preferably, the display method further comprises a step of setting, before displaying each frame of image, an initial operating frequency for the charge pump.

Further preferably, the step of adjusting the operating frequency of the charge pump according to the determination result includes:

adjusting, when the displayed image is determined as a heavy-load image, the operating frequency of the charge pump to be larger than the initial operating frequency; and adjusting, when the displayed image is determined as a light-load image, the operating frequency of the charge pump to be less than the initial operating frequency.

Preferably, the display method further includes a step of controlling, according to the load size of the displayed image, on and off states of a voltage control unit, which is used to control a voltage outputted by the gate driving unit.

Further preferably, the step of controlling on and off states of the voltage control unit according to the load size of the displayed image includes:

controlling, when the displayed image is determined as a heavy-load image, the voltage control unit to be off, so that the voltage control unit controls the gate driving unit to output, in a second period, the same output voltage as that in a first period; and controlling, when the displayed image is determined as a light-load image, the voltage control unit to be on, so that the voltage control unit controls the gate driving unit to output, in the second period, an output voltage less than that in the first period.

Preferably, the step of determining the load size of the displayed image according to the detection result includes:

determining, when the variation degree of data voltages on the respective data lines is detected to be larger than a predetermined degree, the displayed image as a heavy-load image; and determining, when the variation degree of data voltages on the respective data lines is detected to be less than the predetermined degree, the displayed image as a light-load image.

Preferably, the step of detecting the variation degree of data voltages on the respective data lines includes:

detecting the number of variations and/or a variation magnitude of the data voltages on the respective data lines.

The technical solution used for solving the technical problems in the present invention is a display system, which comprises:

a data voltage detecting unit, which is used to detect, when a frame of image is displayed, a variation degree of data voltages on respective data lines;

a determining unit, which is used to determine a load size of the displayed image according to the detection result of the data voltage detecting unit; and a frequency adjusting unit, which is used to adjust, according to the load size of the displayed image determined by the determining unit, an operating frequency of a charge pump, so that a voltage corresponding to the operating frequency is outputted to a gate driving unit by the charge pump, thereby causing the gate driving unit to provide a gate driving voltage to a gate line.

Preferably, the display system further comprises:

a clock unit for setting an initial operating frequency for the charge pump.

Preferably, the display system further comprises:

a detecting register unit, which is used to control the on and off states of a voltage control unit based on the load size of the displayed image, the voltage control unit being used to control an output voltage of the gate driving unit.

Preferably, the data voltage detecting unit is specifically used to detect the number of variations and/or a variation magnitude of the data voltages on the respective data lines.

The beneficial effects of the present invention are as follows.

In the display method provided by the present invention, the load condition of the displayed image is determined by detecting the variation degree (the number of variations and/or variation magnitude) of the data voltages on the respective data lines when displaying each frame of image, and then the operating frequency of the charge pump is adjusted to meet the requirements for driving the displayed images of various loads, thereby saving power without reducing the quality of the displayed image.

The display system of the present invention may display an image by using the above display method, and thus has low power consumption and excellent display performance.

DETAILED DESCRIPTION OF THE EMBODIMENTS

To make those skilled in the art better understand the technical solutions of the present invention, the present invention will be further described in detail below in conjunction with the accompanying drawings and specific implementations.

First Embodiment

Figure 1:
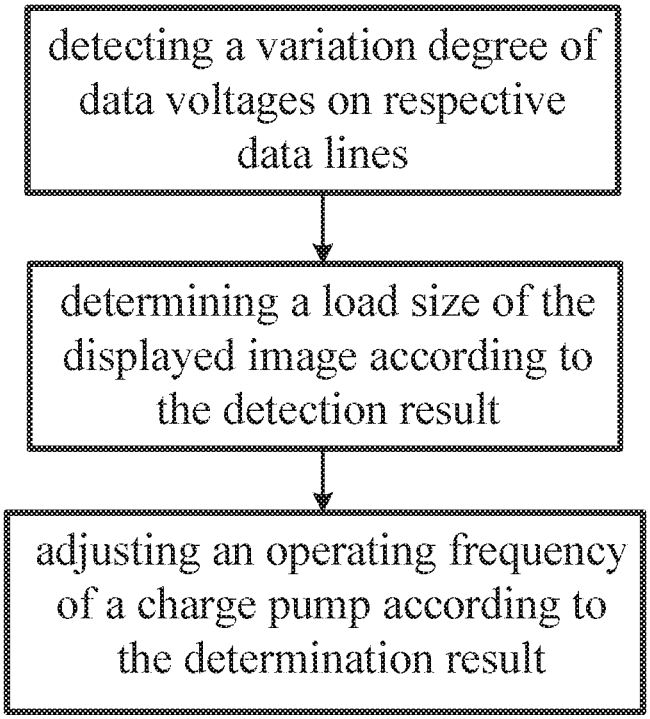
FIG. 1 is a flow chart of a display method provided by a first embodiment of the present invention.

As shown in FIG. 1, this embodiment provides a display method, which comprises the following steps of:

detecting, when each frame of image is displayed, a variation degree of data voltages on respective data lines, determining, according to the detection result, a load size of the displayed image; and adjusting, according to the determination result, an operating frequency of a charge pump, and outputting, by the charge pump, a voltage corresponding to the operating frequency to a gate driving unit, thereby causing the gate driving unit to provide a gate driving voltage to a gate line.

In the display method provided by this embodiment, the load condition of the displayed image is determined by detecting the variation degree (the number of variations and/or variation magnitude) of the data voltages on the respective data lines when displaying each frame of image, and then the operating frequency of the charge pump is adjusted to meet the requirements for driving the displayed images of various loads, thereby saving power without reducing the quality of the displayed image. Detailed description will be given in conjunction with the embodiments below.

Second Embodiment

Figure 2:
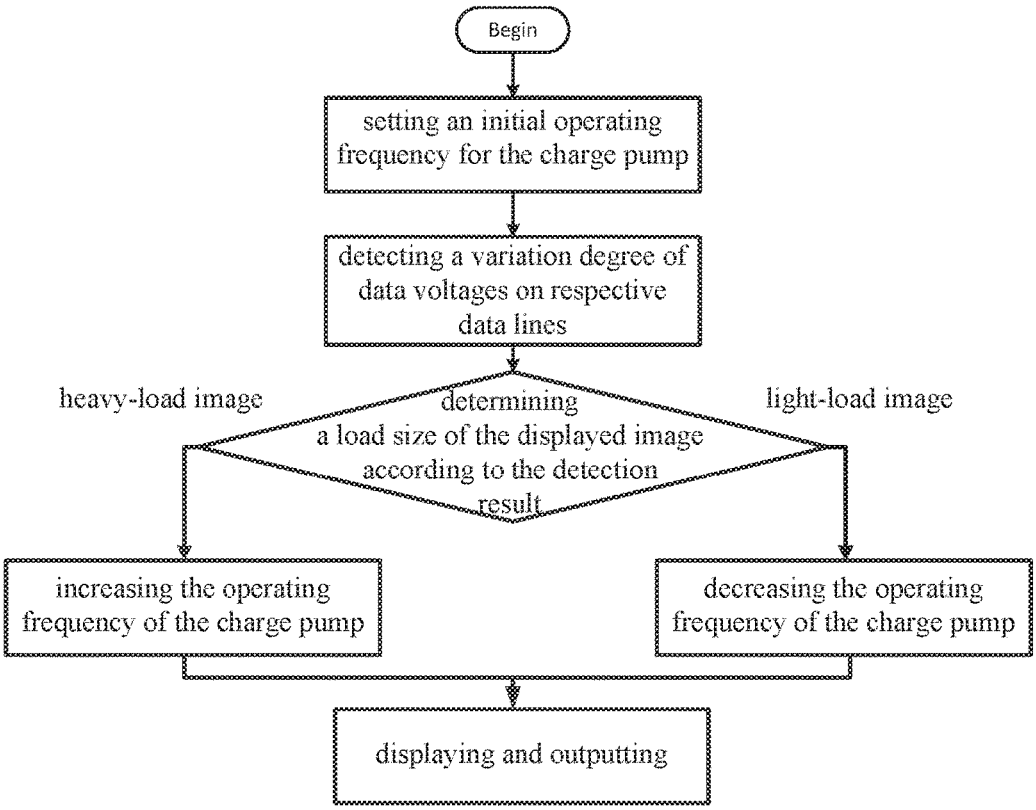
FIG. 2 is a flow chart of a display method provided by a second embodiment of the present invention.

As shown in FIG. 2, this embodiment provides a display method, which specifically includes the following steps.

In Step 1, an initial operating frequency is set for the charge pump before start of displaying an image.

Specifically, a display generally has a clock unit for configuring the initial operating frequency of the charge pump, and the initial operating frequency allows the charge pump to output a voltage, which drives the gate driving unit to output a gate driving voltage for driving a gate line. Generally, this voltage has a value of ±12V.

In Step 2, a variation degree of data voltages on respective data lines is detected when each frame of image is displayed. For example, when the detected variation degree of data voltages on the respective data lines is larger than or equal to a predetermined degree, the displayed image is determined as a heavy-load image; and when the detected variation degree of data voltages on the respective data lines is less than the predetermined degree, the displayed image is determined as a light-load image.

Specifically, the variation degree of data voltages in this step includes the number of variations and/or the variation magnitude of the data voltages on the respective data lines. Generally, if the data voltages on the respective data lines are detected to vary frequently and the variation magnitude is detected to be large, the displayed image is determined as a heavy-load image; otherwise, the displayed image is determined as a light-load image.

In Step 3, a load size of the displayed image is determined according to the variation degree of data voltages on the respective data lines as detected in Step 2.

Specifically, in this step, if the data voltages on the respective data lines are detected to vary frequently and the variation magnitude is detected to be large, the displayed image may be determined as a heavy-load image; otherwise, the displayed image is determined as a light-load image.

In Step 4, the operating frequency of the charge pump is adjusted according to the load condition of the displayed image as determined in Step 3, so as to drive the display panel to display the image.

Specifically, in this step, when the displayed image is determined as a heavy-load image, the operating frequency of the charge pump is adjusted to be larger than the initial operating frequency, so that the charge pump may output, to the gate driving unit, a voltage corresponding to the operating frequency, which drives the gate driving unit to output a gate driving voltage for driving a gate line. In this way, the quality of the displayed image is ensured, and thus the problem of affecting display quality by insufficient charging time for each row of pixels, due to the insufficient driving capability of the gate driving unit caused by inadequate operating frequency of the charge pump, is avoided.

When the displayed image is determined as a light-load image, the operating frequency of the charge pump is adjusted to be less than the initial operating frequency, i.e., the operating frequency of the charge pump is decreased. The decreased operating frequency of the charge pump may result in a decreased driving capability of the pixel turn-on voltage, but for the reason that the displayed image is a light-load image and the rising time and falling time of the pixel turn-on voltage are short, this light-load image can be driven even if the driving capability of the pixel turn-on voltage is decreased. Therefore, the operating frequency of the charge pump may be decreased without affecting the driving state of the light-load image, thereby reducing the power consumption of the charge pump as well as the overall power consumption of the display.

Third Embodiment

Figure 3:
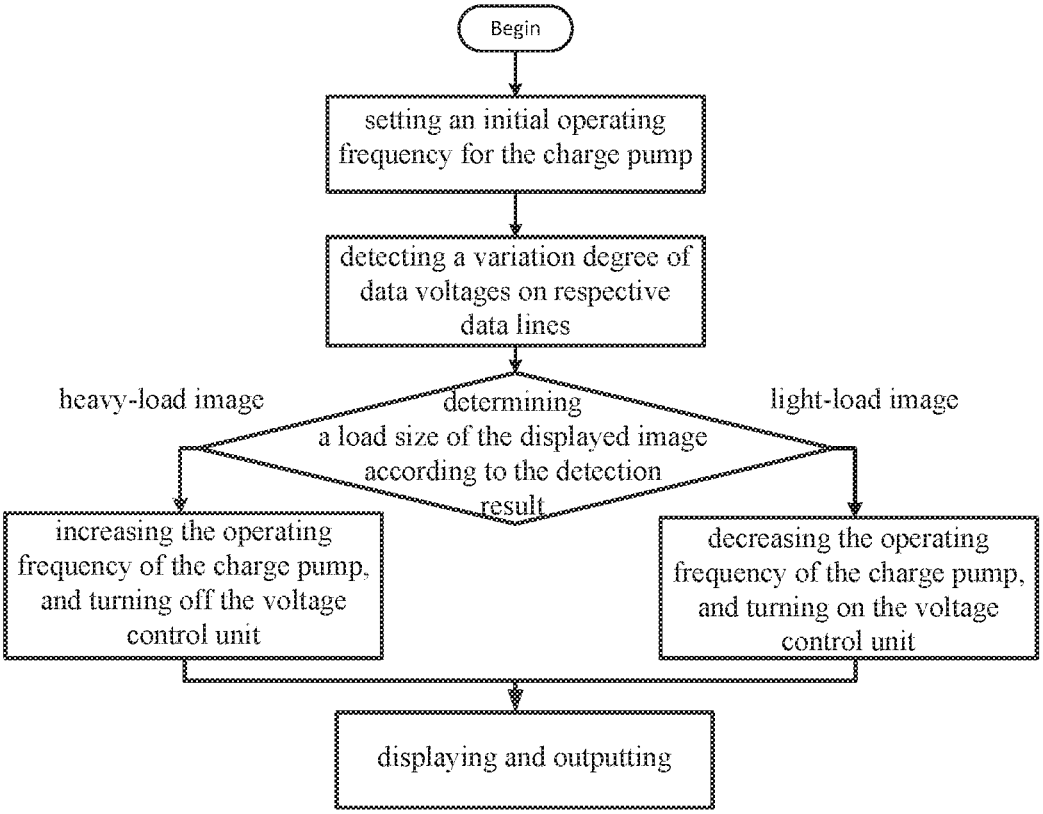
FIG. 3 is a flow chart of a display method provided by a third embodiment of the present invention.

As shown in FIG. 3, this embodiment provides a display method, which is substantially the same as the display method provided by the second embodiment except for Step 4.

Specifically, Step 4 in the display method according to this embodiment not only includes the process of Step 4 according to the second embodiment (i.e., not only includes the step of adjusting the operating frequency of the charge pump according to the load condition of the displayed image as determined in Step 3), but also includes a step of controlling, according to the load size of the displayed image, on and off states of a voltage control unit, which is used to control a voltage outputted by the gate driving unit and may pull down an output voltage of the gate driving unit when turned on. It needs to be set forth that, in the prior art, the voltage control unit maintains constant-on state or constant-off state during display; when it is in the constant-on state, the charging capability for each row of pixels may be insufficient during the display of the heavy-load image, and when it is in the constant-off state, it wastes energy during the display of the light-load image.

Figure 5:
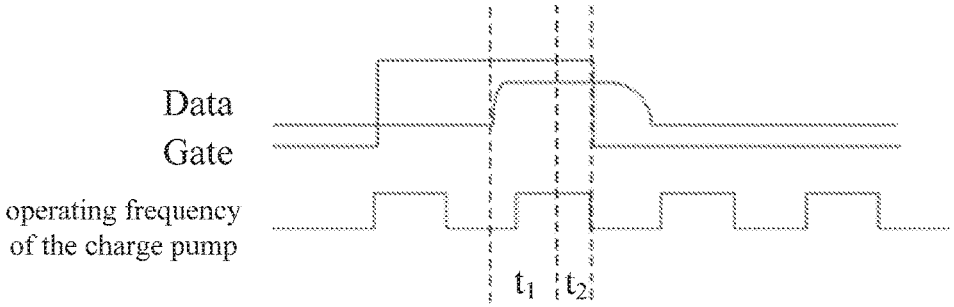
FIG. 5 is a diagram illustrating timings of a gate line, a data line and an operating frequency of a charge pump when a heavy-load image is displayed, according to the display method in the third embodiment of the present invention.
Figure 6:
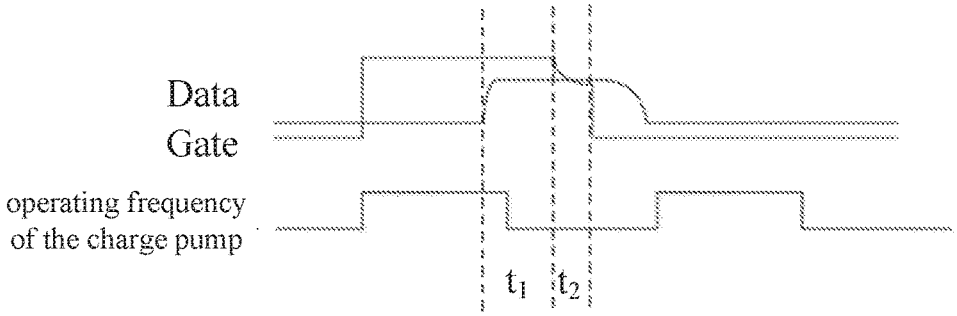
FIG. 6 is a diagram illustrating timings of a gate line, a data line and the operating frequency of the charge pump when a light-load image is displayed, according to the display method in the third embodiment of the present invention.

Specifically, the above step includes a step of controlling, when the displayed image is determined as a heavy-load image, the voltage control unit to be turned off, so that the gate driving unit maintains, during a second period t2, the same output voltage as that in a first period t1, as shown in FIG. 5; and controlling, when the displayed image is determined as a light-load image, the voltage control unit to be turned on, so as to control the gate driving unit to output, during the second period t2, a voltage less than the output voltage in the first period t1 as shown in FIG. 6, and reference may be made to the concave portion in FIG. 6 for the details of the voltage outputted by the gate driving unit during the second period t2. It needs to be set forth that although the voltage outputted by the gate driving unit during the second period t2 is less than that during the first period t1, that is, the output voltage of the gate driving unit is pulled down, such an output voltage is still capable of turning each row of pixels on.

In this embodiment, particularly in the case of determining the displayed image as a light-load image, the voltage control unit is controlled to be on, so as to control the voltage outputted by the gate driving unit in the second period to be less than that in the first period. In other words, the charging and discharging time of respective rows of pixels is reduced, which may thus reduce the power consumption of the display panel. Compared to the second embodiment, the overall power consumption of the display may be further reduced by using the display method according to this embodiment.

Fourth Embodiment

Figure 4:
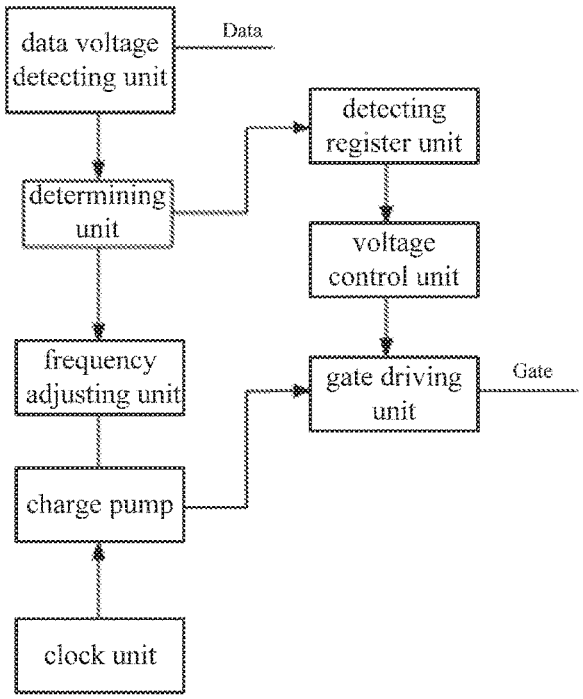
FIG. 4 is a schematic diagram of a display system provided by a fourth embodiment of the present invention.

As shown in FIG. 4, this embodiment provides a display system, which may perform image display by using the display method according to any one of the first to third embodiments. Specifically, the display system includes a data voltage detecting unit, a determining unit and a frequency adjusting unit. The data voltage detecting unit is used to detect, when each frame of image is displayed, a variation degree of data voltages on respective data lines, and specifically detect the number of variations and/or the variation magnitude of the data voltages on the respective data lines. The determining unit is used to determine the load size of the displayed image according to the detection result of the data voltage detecting unit. The frequency adjusting unit is used to adjust, according to the load size of the displayed image determined by the determining unit, an operating frequency of a charge pump, so that a voltage corresponding to the operating frequency is outputted to a gate driving unit by the charge pump, thereby causing the gate driving unit to provide a gate driving voltage to a gate line.

Since the display system according to this embodiment includes the data voltage detecting unit, the determining unit and the frequency adjusting unit, the variation degree (number of variations and/or variation magnitude) of the data voltages on the respective data lines may be detected by the data voltage detecting unit when each frame of image is displayed, and the load condition for the displayed image is determined by the determining unit based on the detection result of the data voltage detecting unit, and then the operating frequency of the charge pump is adjusted by the frequency adjusting unit based on the determination result of the determining unit so as to meet the requirements for driving displayed images of various loads, thereby saving power while ensuring the quality of image.

In addition, the display system according to this embodiment further includes a clock unit for setting an initial operating frequency for the charge pump. The initial operating frequency allows the charge pump to output a voltage, which can drive the gate driving unit to output a gate driving voltage for driving a gate line. Generally, this voltage has a value of ±12V (in a case that the pixel transistor is of an a-Si type).

The display system according to this embodiment further includes a detecting register unit, which is used to control on and off states of a voltage control unit based on the load size of the displayed image, the voltage control unit being used to control an output voltage of the gate driving unit. Specifically, when the displayed image is a heavy-load image, the detecting register unit may output a low-level control signal for controlling the voltage control unit to be off, and when the displayed image is a light-load image, the detecting register unit may output a high-level signal for controlling the voltage control unit to be on, so as to adjust (pull down) the output voltage of the gate driving unit, which thus saves the power consumption.

The display system according to the present invention may be a display device with the function of display, such as a mobile phone, a computer or the like.

It can be understood that the foregoing implementations are merely exemplary implementations used for describing the principle of the present invention, but the present invention is not limited thereto. Those of ordinary skill in the art may make various variations and improvements without departing from the spirit and essence of the present invention, and these variations and improvements shall fall into the protection scope of the present invention.

What is claimed is:

1. A display method, comprising steps of:

detecting, when a frame of image is displayed, a variation degree of data voltages on respective data lines;

determining, according to the detection result, a load size of the displayed image; and adjusting, according to the determination result, an operating frequency of a charge pump, and outputting, by the charge pump, a voltage corresponding to the operating frequency to a gate driving unit, so that a gate driving voltage is provided to a gate line by the gate driving unit.

2. The display method according to claim 1, further comprising a step of setting, before displaying each frame of image, an initial operating frequency for the charge pump.

3. The display method according to claim 2, wherein the step of adjusting the operating frequency of the charge pump according to the determination result includes:

adjusting, when the displayed image is determined as a heavy-load image, the operating frequency of the charge pump to be larger than the initial operating frequency; and adjusting, when the displayed image is determined as a light-load image, the operating frequency of the charge pump to be less than the initial operating frequency.

4. The display method according to claim 1, further comprising a step of controlling, according to the load size of the displayed image, on and off states of a voltage control unit, the voltage control unit being used to control a voltage outputted by the gate driving unit.

5. The display method according to claim 4, wherein the step of controlling on and off states of the voltage control unit according to the load size of the displayed image includes:

controlling, when the displayed image is determined as a heavy-load image, the voltage control unit to be off, so that the voltage control unit controls the gate driving unit to output, in a second period, a same output voltage as that in a first period; and controlling, when the displayed image is determined as a light-load image, the voltage control unit to be on, so that the voltage control unit controls the gate driving unit to output, in the second period, an output voltage less than that in the first period.

6. The display method according to claim 1, wherein the step of determining the load size of the displayed image according to the detection result includes:

determining, when the variation degree of data voltages on the respective data lines is detected to be larger than a predetermined degree, the displayed image as a heavy-load image; and determining, when the variation degree of data voltages on the respective data lines is detected to be less than the predetermined degree, the displayed image as a light-load image.

7. The display method according to claim 1, wherein the step of detecting the variation degree of data voltages on the respective data lines specifically includes:

detecting the number of variations and/or a variation magnitude of the data voltages on the respective data lines.

8. The display method according to claim 2, wherein the step of detecting the variation degree of data voltages on the respective data lines specifically includes:

detecting the number of variations and/or a variation magnitude of the data voltages on the respective data lines.

9. The display method according to claim 3, wherein the step of detecting the variation degree of data voltages on the respective data lines specifically includes:

detecting the number of variations and/or a variation magnitude of the data voltages on the respective data lines.

10. The display method according to claim 4, wherein the step of detecting the variation degree of data voltages on the respective data lines specifically includes:

detecting the number of variations and/or a variation magnitude of the data voltages on the respective data lines.

11. The display method according to claim 5, wherein the step of detecting the variation degree of data voltages on the respective data lines specifically includes:

detecting the number of variations and/or a variation magnitude of the data voltages on the respective data lines.

12. The display method according to claim 6, wherein the step of detecting the variation degree of data voltages on the respective data lines specifically includes:

detecting the number of variations and/or a variation magnitude of the data voltages on the respective data lines.

13. A display system, comprising:

a data voltage detecting unit, which is used to detect, when a frame of image is displayed, a variation degree of data voltages on respective data lines;

a determining unit, which is used to determine a load size of the displayed image according to the detection result of the data voltage detecting unit; and a frequency adjusting unit, which is used to adjust, according to the load size of the displayed image determined by the determining unit, an operating frequency of a charge pump, so that a voltage corresponding to the operating frequency is outputted to a gate driving unit by the charge pump, thereby causing the gate driving unit to provide a gate driving voltage to a gate line.

14. The display system according to claim 13, further comprising:

a clock unit, which is used to set an initial operating frequency for the charge pump.

15. The display system according to claim 13, further comprising:

a detecting register unit, which is used to control on and off states of a voltage control unit based on the load size of the displayed image, the voltage control unit being used to control an output voltage of the gate driving unit.

16. The display system according to claim 13, wherein the data voltage detecting unit detects the number of variations and/or a variation magnitude of the data voltages on the respective data lines.

17. The display system according to claim 14, wherein the data voltage detecting unit detects the number of variations and/or a variation magnitude of the data voltages on the respective data lines.

18. The display system according to claim 15, wherein the data voltage detecting unit detects the number of variations and/or a variation magnitude of the data voltages on the respective data lines.

* * * * *